US009169723B2

(12) United States Patent
Amaral et al.

(10) Patent No.: US 9,169,723 B2
(45) Date of Patent: Oct. 27, 2015

(54) SYSTEM AND METHOD FOR TREATMENT OF WELL COMPLETION EQUIPMENT

(75) Inventors: Anderson da Silva Amaral, Spring, TX (US); Eddie G. Bowen, Porter, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 849 days.

(21) Appl. No.: 13/357,971

(22) Filed: Jan. 25, 2012

(65) Prior Publication Data

US 2013/0186631 A1 Jul. 25, 2013

(51) Int. Cl.

| | |
|---|---|
| ***E21B 21/08*** | (2006.01) |
| ***E21B 21/10*** | (2006.01) |
| ***E21B 43/08*** | (2006.01) |
| ***E21B 43/12*** | (2006.01) |
| ***E21B 41/02*** | (2006.01) |

(52) U.S. Cl.
CPC ..... *E21B 43/12* (2013.01); *E21B 41/02* (2013.01)

(58) Field of Classification Search
CPC ..... E21B 21/08; E21B 21/10; E21B 43/08
USPC ..... 166/205, 373, 310, 242.5; 137/13
See application file for complete search history.

(56) References Cited

U.S. PATENT DOCUMENTS

| | | | |
|---|---|---|---|
| 6,851,444 | B1 | 2/2005 | Kohl et al. |
| 6,983,796 | B2 | 1/2006 | Bayne et al. |
| 7,234,524 | B2 | 6/2007 | Shaw et al. |
| 7,389,787 | B2 | 6/2008 | Means et al. |
| 8,127,831 | B2 | 3/2012 | Haeberle et al. |
| 2005/0072570 | A1 | 4/2005 | Lehman et al. |
| 2006/0289156 | A1 | 12/2006 | Murray |
| 2007/0227737 | A1 | 10/2007 | Delaloye et al. |
| 2007/0284110 | A1 | 12/2007 | Harris et al. |
| 2007/0289740 | A1 | 12/2007 | Thigpen et al. |
| 2009/0095351 | A1 | 4/2009 | Greening et al. |
| 2012/0000641 | A1 * | 1/2012 | Panga et al. ..... 166/51 |

OTHER PUBLICATIONS

PCT/US2012/067967—International Search Report dated Dec. 5, 2012.

Corbett et al., "Fiber Optic Monitoring Openhole Gravel Pack Completions," Baker Oil Tools SPE 77682.

* cited by examiner

*Primary Examiner* — Catherine Loikith

(74) *Attorney, Agent, or Firm* — Mossman, Kumar & Tyler PC

(57) ABSTRACT

An apparatus for controlling a flow of a fluid between a wellbore tubular having an opening and a formation includes a particulate control device and a flow control device positioned adjacent to the particulate control device. A flow path is formed between the opening of the wellbore tubular and the formation and that is internal to the particulate control device and the flow control device. The apparatus may include an additive supply line having an outlet positioned to dispense at least one additive into the flow path. A related method for controlling a flow of a fluid between a wellbore tubular having an opening and a formation may include positioning a flow control device adjacent to a particulate control device in the wellbore and dispensing at least one additive into a flow path internal to the particulate control device and the flow control device.

19 Claims, 2 Drawing Sheets

SYSTEM AND METHOD FOR TREATMENT OF WELL COMPLETION EQUIPMENT

CROSS-REFERENCE TO RELATED APPLICATION

None.

BACKGROUND OF THE DISCLOSURE

1. Field of the Disclosure

The disclosure relates generally to systems and methods for selective control of fluid flow between a wellbore tubular such as a production string and a subterranean formation.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. Fluid from each production zone entering the wellbore is drawn into tubing that runs to the surface. It is desirable to control drainage at the production zone(s). Additionally, it may be desired to inject a fluid into the formation in order to enhance production rates or drainage patterns. Thus, wells can include various subsurface equipment suited to manage fluid flow at one or more production zones. The well environment, however, can contain substances that are corrosive or otherwise harmful to subsurface well equipment.

The present disclosure addresses the need to protect well equipment from harmful substances as other needs of the prior art.

SUMMARY OF THE DISCLOSURE

In aspects, the present disclosure provides an apparatus for controlling a flow of a fluid between a wellbore tubular having an opening and a formation. The apparatus may include a particulate control device, a flow control device positioned adjacent to the particulate control device, a flow path between the opening of the wellbore tubular and the formation and that is internal to the particulate control device and the flow control device, and an additive supply line having an outlet positioned to dispense at least one additive into the flow path.

In aspects, the present disclosure provides a method for controlling a flow of a fluid between a wellbore tubular having an opening and a formation. The method may include positioning a flow control device adjacent to a particulate control device in the wellbore and dispensing at least one additive into a flow path internal to the particulate control device and the flow control device, a flow path extending between the opening of the wellbore tubular and the formation.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE DISCLOSURE

The present disclosure relates to devices and methods for treating subsurface well equipment with one or more additives. These devices and methods may be utilized to introduce or inject a variety of chemicals or materials (hereafter 'additives') into a well to control, among other things, corrosion, scale, paraffin, emulsion, hydrates, hydrogen sulfide, asphaltenes, inorganics and other harmful substances. As used herein, the term "additive" generally refers to an engineered material that is formulated to perform a desired task. The additive(s) may be mixed with a base fluid such as water or oil. A well treatment program using one or more additives can extend the life of a completion, and therefore delay or eliminate the need for intervention.

Generally, the systems according to the present disclosure use flow lines that treat internal features (e.g., channels or orifices) of a flow control device without using injection nipples at a 'pay zone' face. The system may be used in open hole or cased hole completions, which may or may not be gravel packed. The system may continuously pump additives through small diameter flow lines down to the pay zone. The additive(s) may be dispensed inside an inflow control device (ICD) to protect the internal parts of the ICD against any scaling, corrosion, etc.

Figure 1:
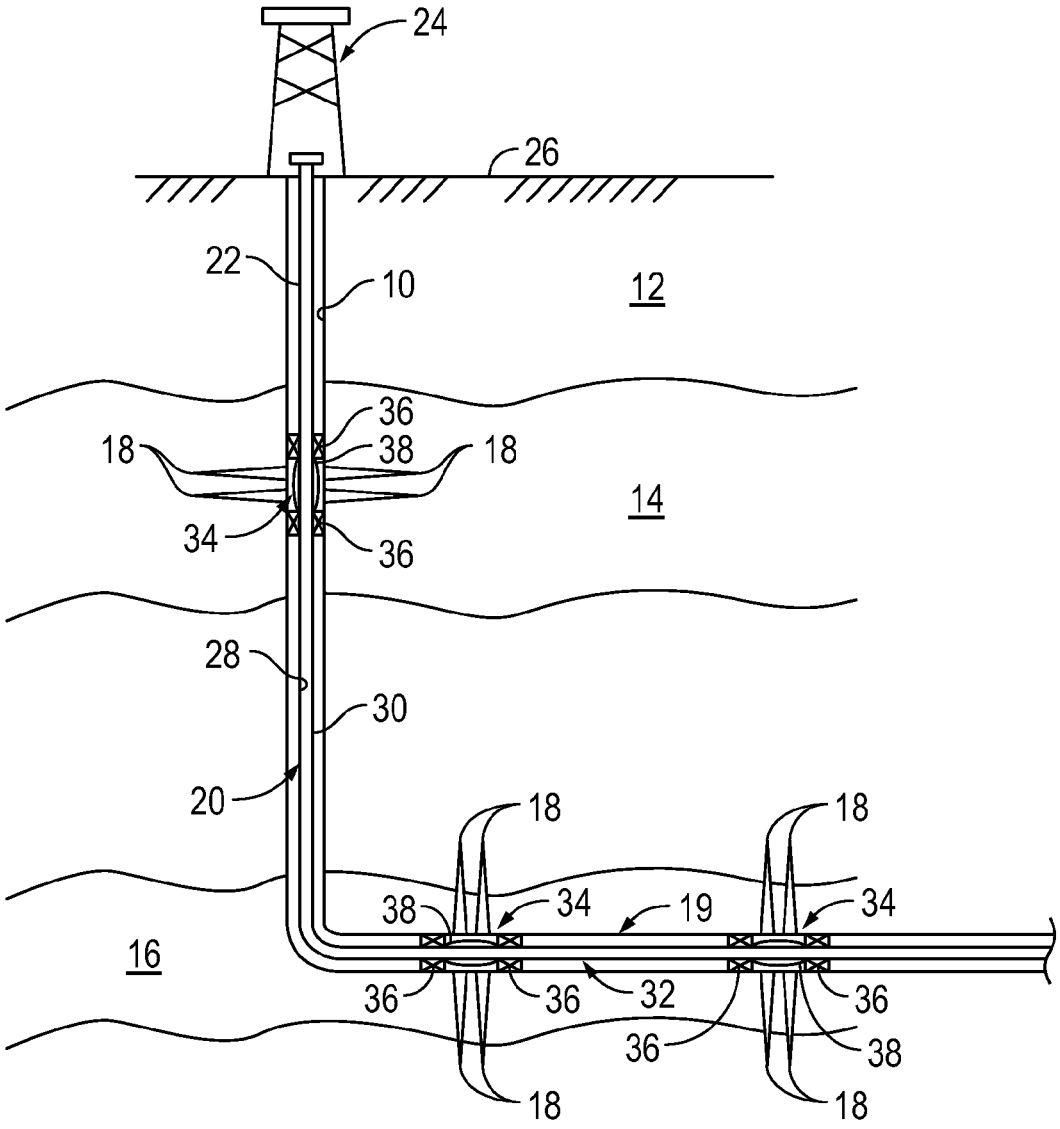
FIG. 1 is a schematic elevation view of an exemplary multi-zonal production well which incorporates an additive treatment system in accordance with one embodiment of the present disclosure.

FIG. 1 illustrates a hydrocarbon producing well that may use additive systems according to the present disclosure. In FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production control devices 34 are positioned at selected points along the production assembly 20. The production control device 34 may control the flow of fluids from a reservoir into a production string, or "in-flow" and/or the flow from the production string into the reservoir, or "injection." The control devices 34 can be distributed along a production well to provide fluid control and/or injection at multiple locations or "nodes." Optionally, each production device 34 is isolated within the wellbore 10 by a pair of packer devices 36. Although only two production devices 34 are shown in FIG. 1, there may, in fact, be a large number of such production devices arranged in serial fashion along the wellbore 10.

Figure 2:
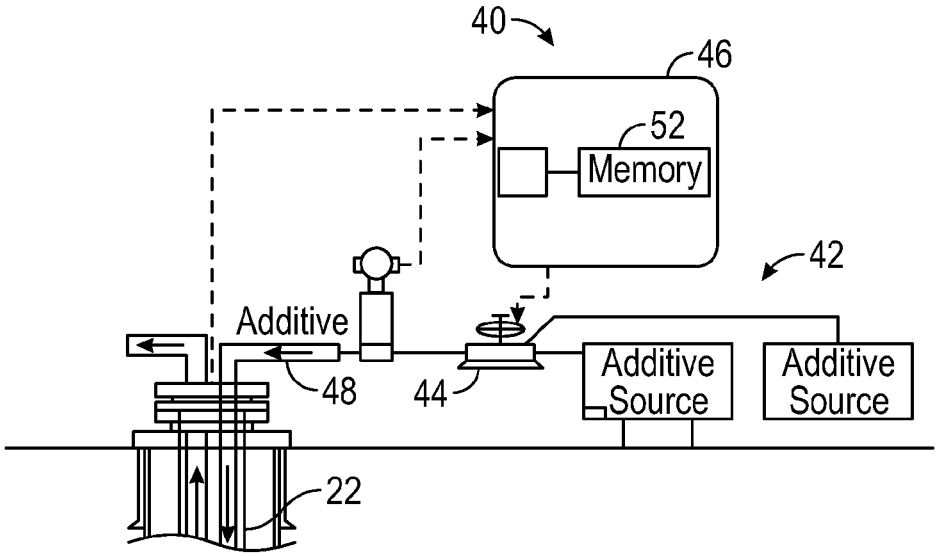
FIG. 2 is a schematic elevation view of the surface components of an additive treatment system in accordance with one embodiment of the present disclosure.

Referring now to FIG. 2, there is shown an additive supply system 40 for supplying one or more additives to the well 10. In one embodiment, the system 40 may include an additive supply unit 42, an injector unit 44, and a controller 46. The system 40 may direct the additive(s) into an umbilical 48 disposed inside or outside of the production tubular 22. The additive supply unit 42 may include multiple tanks for storing different chemicals and one or more pumps for pumping the additives. This supply of additives may be continuous or intermittent. The injector unit 44 selectively injects these additives into the umbilical 48. The injector unit 44 may be a pump such as a positive displacement pump, a centrifugal pump, a piston-type pump, or other suitable device for pumping fluid. The controller 46 may be configured to control the additive injection process by, in part, controlling the operation of the additive supply unit 42 and the injector unit 44. The controller 46 may control operations by utilizing programs stored in a memory 50 associated with the controller 46.

Figure 3A:
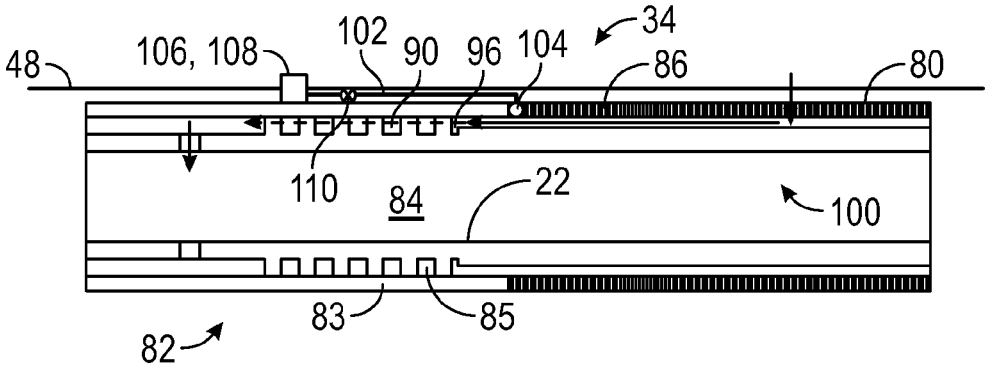
FIG. 3A is a schematic cross-sectional view of an exemplary production control device made in accordance with one embodiment of the present disclosure that dispenses additives into an inflowing fluid from a formation.

Referring now to FIG. 3A, the production control device 34 includes a particulate control device 80 for reducing the amount and size of particulates entrained in the fluids and a flow control device 82. The particulate control device 80 can include a membrane that is fluid permeable but impermeable by particulates. Illustrative devices may include, but are not limited to, a wire wrap, sintered beads, sand screens and associated gravel packs, etc. In one arrangement, a wire mesh 86 may be wrapped around an unperforated production string 88. The flow control device 82 may control one or more flow parameters or characteristics relating to fluid flow between an annulus 30 (FIG. 1) and a flow bore 84 of the production string 22. Illustrative flow control devices 82 may have a housing 83 that includes flow features 85 such helical channels, orifices, tortuous flow paths, or other known elements or geometries that can control parameters such as pressure drops in a flowing fluid.

To treat internal surfaces and components, the production control device 34 may include a treatment system 100. The treatment system 100 may receive a fluid stream from an umbilical 48. The umbilical 48 may be tubing, pipe, hose or other suitable device for conveying fluid that is positioned external to the production control device 34. For instance, the umbilical 48 may be strapped or otherwise secured to the outer surface of the production string 22 (FIG. 1). The treatment system 100 may include a supply line 102 in fluid communication with the umbilical 48. The line 102 has an outlet 104 positioned internal to the production control device 34 and along a flow path 96 internal to the production control device 34. In the FIG. 3A embodiment, the flow path 96 has a portion within the particulate control device 80 and a portion within the flow control device 82. The outlet 104 is shown positioned proximate to the particulate control device 80. This position may be advantageous when the production control device 34 is encountering fluid flow from the formation, such as that shown with the arrows 90. Injecting the additive into the inflowing formation fluid 90 allows the additive to flow along and contact the internals of the production control device 34. Thus, the injected additive treats a majority of the flow path 96, but does not contact the surfaces of the production control device 34 that are exposed to the wellbore annulus 30 (FIG. 1).

The treatment system 100 may also include a flow regulator 106 and a splitter 108 to control the flow of fluids from the umbilical 48 into the line 102. As noted previously, a well may have multiple nodes. Thus, a flow regulator 106 and splitter 108 cooperate to evenly distribute additives among the nodes. For example, the splitter 108 may form two fluid streams, one for the production control device 34 and the other for an adjacent production control device (FIG. 1). The flow regulator 106 may be configured to control one or more parameters of the fluid stream entering the production control device 34 (e.g., flow rate, pressure, etc.). Also, one or more check valves 110 may be used to ensure fluid travels in only one desired direction. These devices may be integrated into the production device 34 as shown.

Figure 3B:
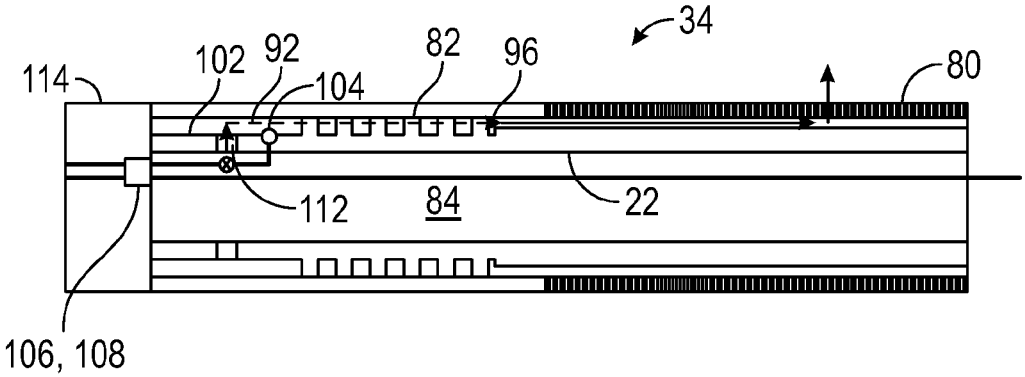
FIG. 3B is a schematic cross-sectional view of an exemplary production control device made in accordance with one embodiment of the present disclosure that dispenses additives into a fluid to be injected into a formation.

Referring now to FIG. 3B, there is shown another embodiment of a production control device 34. Similar to the FIG. 3A embodiment, the production control device 34 includes a particulate control device 80 and a flow control device 82. Also, the FIG. 3B embodiment includes a treatment system 100 that includes a supply line 102 having an outlet 104. In this embodiment, the supply line 102 is positioned internal to the production control device 34. The supply line 102 may run along the internal flow path 96 or be embedded in the production tubing 22. The outlet 104, is positioned proximate to an opening 112 in the production string 22. This position may be advantageous when the production control device 34 is encountering fluid flow from the bore 84 of the production string 22. Such fluid flow is shown with arrows labeled 92. Injecting the additive into the inflowing fluid 92 allows the additive(s) to contact the internals of the production control device 34. Thus, the injected additive treats a majority of the flow path 96, but does not contact the surfaces defining the wellbore tubular bore 84.

A distinguishing feature of the FIG. 3B, embodiment is that a separate housing or sub 114 receives the flow regulator 106 and splitter 108. The sub 114 may be removable connectable with the production control device 34. That is, the sub 114 may include features such as threads, mating slots or grooves, that allow connection/disconnection with the production control device 34.

Referring now to FIGS. 1-2 and 3A, in a production mode, one or more additives are pumped into the well 10 via the umbilical 48. The umbilical 48 supplies additives to a plurality of "nodes" or distributed production control devices 34. At each node where fluids are flowing into the production string 22, the flow regulator 106 and splitter 108 allow a predetermined amount of additive or additives to be injected or dispensed into the fluids entering the production control device 34 from the annulus 30. The inflowing fluid commingles with the additive(s) and flows through the flow path 96, which allows the internal surfaces along the flow path 96 to be treated, and enters the bore 84. As noted previously, the proximity of the outlet 104 to the particulate control device 80 allows the additive(s) to treat a majority of the surfaces defining the internal flow path 96.

Referring now to FIGS. 1-2 and 3B, in an injection mode, one or more additives are also pumped into the well 10 via the umbilical 48 to one or more nodes. At each node where fluids are flowing out of the production string 22, the flow regulator 106 and splitter 108 allow a predetermined amount of additive or additives to be dispensed into the fluids entering the production control device 34 from the bore 84. The fluid from the bore 84 commingles with the additive(s) and flows through the flow path 96, which allows the internal surfaces along the flow path 96 to be treated, and exits into the annulus 30. As noted previously, the proximity of the outlet 104 to production string opening 112 allows the additive(s) to treat a majority of the surfaces defining the internal flow path 96.

While FIG. 1 illustrates a cased well, it should be understood that embodiments of the present disclosure may also be used in an exemplary open hole wellbore arrangement. Such arrangements have an uncased borehole that is directly open to the formation. Production fluids, therefore, flow directly from the formation and into the annulus that is defined between the production assembly and the wall of the wellbore. There are no perforations, and open hole packers may be used to isolate the production control devices. In some instances, packers maybe omitted from the open hole completion.

As used in the disclosure, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water.

For the sake of clarity and brevity, descriptions of most threaded connections between tubular elements, elastomeric seals, such as o-rings, and other well-understood techniques are omitted in the above description. Further, terms such as "valve" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

The present disclosure is susceptible to embodiments of different forms. There are shown in the drawings, and herein will be described in detail, specific embodiments of the present disclosure with the understanding that the present disclosure is to be considered an exemplification of the principles of the disclosure and is not intended to limit the disclosure to that illustrated and described herein.

What is claimed is:

1. An apparatus for controlling a flow of a fluid between a wellbore tubular having an opening and a formation, comprising:

a particulate control device;

a flow control device positioned adjacent to the particulate control device;

a flow path between the opening of the wellbore tubular and the formation, the flow path being internal to the particulate control device and the flow control device; and an additive supply line having an outlet positioned to dispense at least one additive into the flow path.

2. The apparatus according to claim 1, further comprising an umbilical conveying at least one additive from a surface location; and a splitter splitting the at least one additive into a plurality of fluid streams, wherein one of the plurality of fluid streams is directed to the additive supply line.

3. The apparatus according to claim 2, further comprising a flow regulator operatively connected to the additive supply line, the flow regulator being configured to control at least one flow parameter relating to the fluid stream in the additive supply line.

4. The apparatus according to claim 3, further comprising a sub configured to receive the splitter and the flow regulator.

5. The apparatus according to claim 1, wherein the outlet is positioned proximate to the particulate control device.

6. The apparatus according to claim 1, wherein the outlet is positioned proximate to the opening in the wellbore tubular.

7. The apparatus according to claim 1, further comprising a check valve in fluid communication with an additive line, the check valve being configured to cause unidirectional flow in the additive line.

8. The apparatus according to claim 1, wherein the opening provides fluid communication between a bore of the wellbore tubular and the flow path; and wherein the outlet of the additive supply line is positioned between the opening and the particulate control device.

9. The apparatus according to claim 8, wherein the outlet is positioned to dispense the at least one additive into a portion of the flow path internal to the particulate control device.

10. The apparatus according to claim 8, wherein the outlet is positioned to dispense the at least one additive into a portion of the flow path internal to the flow control device.

11. The apparatus according to claim 8, wherein the particulate control device and the flow control device are serially arranged between the opening and the formation.

12. The apparatus according to claim 11, wherein fluid flows serially from one of: (i) from a bore of the wellbore tubular serially through the flow control device and the particulate control device to the formation, and (ii) from the formation serially through the particulate control device and the flow control device to a bore of the wellbore tubular.

13. A method for controlling a flow of a fluid between a wellbore tubular having an opening and a formation, comprising:

positioning a flow control device adjacent to a particulate control device in the wellbore tubular; and dispensing at least one additive into a flow path internal to the particulate control device and the flow control device, a flow path extending between the opening of the wellbore tubular and the formation.

14. The method according to claim 13, conveying the at least one additive from a surface location using an umbilical; splitting the at least one additive into a plurality of fluid streams using a splitter; and directing one of the plurality of fluid streams into an additive supply line in communication with the flow path.

15. The method according to claim 14, further comprising controlling at least one flow parameter relating to the fluid stream in the additive supply line using a flow regulator.

16. The method according to claim 15, further positioning the splitter and the flow regulator in a sub.

17. The method according to claim 13, wherein the at least one additive is dispensed proximate to the particulate control device.

18. The method according to claim 13, wherein the at least one additive is dispensed proximate to the opening in the wellbore tubular.

19. The method according to claim 13, further comprising causing unidirectional flow of the at least one additive into the flow path using a check valve.

* * * * *